United States Patent [19]

Sütterlin et al.

[11] Patent Number: 4,880,433

[45] Date of Patent: Nov. 14, 1989

[54] PROCESS FOR AFTERTREATING CELLULOSIC MATERIALS PRINTED WITH REACTIVE DYES

[75] Inventors: Wolfgang Sütterlin, Lörrach-Haagen, Fed. Rep. of Germany; Raymond Défago, Riehen, Switzerland

[73] Assignee: Ciba-Geigy Corporation, Ardsley, N.Y.

[21] Appl. No.: 7,835

[22] Filed: Jan. 27, 1987

[30] Foreign Application Priority Data

Jan. 29, 1986 [CH] Switzerland ..... 327/86

[51] Int. Cl.[4] ..... D06M 1/00

[52] U.S. Cl. ..... 8/182; 8/188; 8/192; 8/648; 8/680

[58] Field of Search ..... 8/543, 680, 648, 188, 8/185, 184, 192, 196, 182

[56] References Cited

U.S. PATENT DOCUMENTS 4,384,121 5/1983 Meyer ..... 548/217
4,432,886 0/1984 Meyer ..... 252/301.27
4,433,975 0/1984 Meyer ..... 8/648
4,478,598 10/1984 Meyer et al. ..... 8/648

FOREIGN PATENT DOCUMENTS 0151370 8/1985 European Pat. Off. .
8779481 1/1961 United Kingdom .
0952680 3/1964 United Kingdom .
2007253 3/1979 United Kingdom .

OTHER PUBLICATIONS

Book Pap. National Tech. Conf.-ATCC, 1983, pp. 32–44.

*Primary Examiner*—Paul Lieberman
*Assistant Examiner*—John F. McNally
*Attorney, Agent, or Firm*—Wenderoth, Lind & Ponack

[57] ABSTRACT

There is disclosed a process for aftertreating cellulose and cellulosic materials printed with reactive dyes by treating said printed material with an aqueous liquor that contains at least one cationic assistant, at least one amphoteric and/or at least one cationic fluorescent whitening agent. The prints so obtained have very good washfastness, especially very good wetfastness, and the required degree of whiteness.

10 Claims, No Drawings

PROCESS FOR AFTERTREATING CELLULOSIC MATERIALS PRINTED WITH REACTIVE DYES

Exacting requirements regarding fastness properties on the one hand and mild formaldehyde finishing on the other mean that cellulose or cellulosic materials printed with reactive dyes often have to be subjected to an aftertreatment, in particular to an aftertreatment for improving the wetfastness properties of the printed materials.

This aftertreatment is carried out in particular with cationic assistants, either directly after the washing-off step or after the goods have been washed and dried. In the great majority of cases, however, material printed with reactive dyes is simultaneously whitened when being finished. However, the conventional anionic fluorescent whitening agents are not compatible with the cationic assistants, as uncontrolled precipitation results, so that up to now these methods have not been altogether technically feasible.

Surprisingly, it has now been found that it is possible to improve the wetfastness properties of, and simultaneously to whiten, cellulose and cellulosic materials printed with reactive dyes by using amphoteric and/or cationic fluorescent whitening agents together with the cationic assistant.

Accordingly, the invention relates to a process for aftertreating cellulose or cellulosic materials printed with reactive dyes by using an aqueous aftertreatment liquor that contains at least one cationic assistant and at least one amphoteric fluorescent whitening agent and/or at least one cationic fluorescent whitening agent.

This process makes it possible to obtain prints that, on the one hand, have very good fastness properties, especially very good wetfastness, and, on the other, exhibit the required degree of whiteness.

The cationic assistants eligible for use in the process of this invention are preferably those that improve the wetfastness properties such as fastness to water, perspiration, wet pressing, and sea water.

Examples of such suitable cationic assistants are derivatives of ammonia and/or of imidazoline containing two long chain aliphatic saturated or unsaturated radicals such as 1-methyl-1-oleylamidoethyl-2-oleylimidazolinium. $X^{\ominus}$, 1-methyl-1-stearylamidoethyl-2-stearylimidazolinium. $X^{\ominus}$, distearyldimethylammonium. $X^{\ominus}$, or a compound of formula

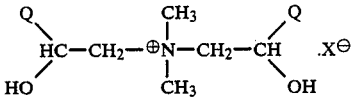

wherein Q is $C_{14}$–$C_{16}$alkyl and $X^{\ominus}$ is the chloride, bromide, methylsulfate, ethylsulfate, methane, ethane or toluenesulfonate anion. Also suitable are amine/formaldehyde condensates such as a condensate of ethylenediamine dihydrochloride, dicyandiamine and formaldehyde.

The cationic assistants are added to the aftertreatment liquor in amounts of 1 to 10 g/l.

Amphoteric fluorescent whitening agents may belong to a very wide range of chemical classes. In the context of this invention, particularly interesting fluorescent whitening agents are those of formula

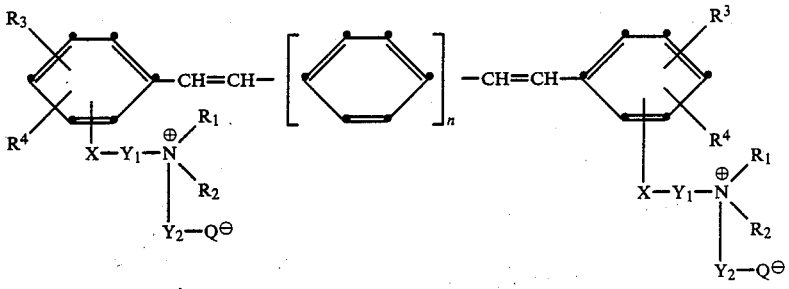

wherein

X is oxygen, sulfur, a direct bond, $—SO_2N(R_5)—$, $—CON(R_5)—$ or —COO—, $Y_1$ and $Y_2$ are each independently of the other $C_1$–$C_4$alkylene or hydroxypropylene, $R_1$ and $R_2$ are each independently of the other $C_1$–$C_4$alkyl or together with the N-atom are a pyrrolidine, piperidine, hexamethylenimine or morpholine ring, and $R_1$ together with $R_5$ are also a piperizine ring, $R_3$ and $R_4$ are hydrogen, $C_1$–$C_4$alkyl, chlorine, $C_1$–$C_4$alkoxy, $C_3$–$C_4$alkenyl, or in ortho-position to each other $R_3$ and $R_4$ together are a trimethylene or tetramethylene group, $R_5$ is hydrogen, $C_1$–$C_4$alkyl, cyanoethyl, or together with $R_1$ is a piperazine ring, Q is —COO or $—SO_3$, and n is 1 or 2.

A particularly preferred amphoteric fluorescent whitening agent of this class is that of formula

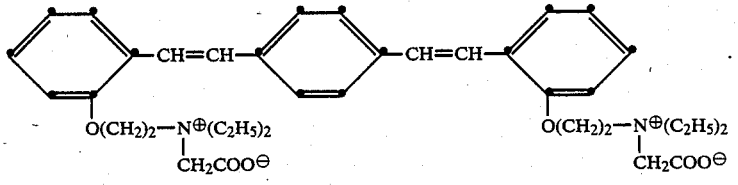

Cationic fluorescent whitening agents can also belong to a very wide range of chemical structures. Representative of the multiciplicity of these cationic fluorescent whitening agents are e.g. benzofurans of formula

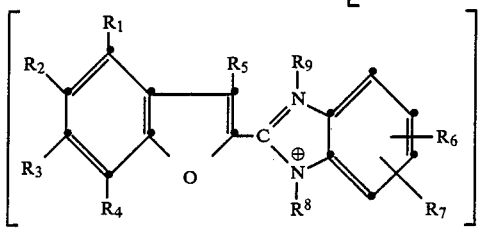

wherein $R_1$ is hydrogen, halogen, a lower alkyl or lower alkoxy group, or together with $R_2$ complete a fused benzene ring, $R_2$ is hydrogen, a lower alkyl or lower alkoxy group, halogen, a carboxyl, carbalkoxy, carbamoyl, mono- or dialkylcarbamoyl, sulfonyl, alkylsulfonyl, alkoxysulfonyl, sulfamoyl or mono- or dialkylsulfamoyl group, or together with $R_1$ or $R_3$ complete a fused benzene ring, $R_3$ is hydrogen, halogen, or a lower alkyl or lower alkoxy group, or together with $R_2$ or $R_4$ complete a fused benzene ring, $R_4$ is hydrogen, a lower alkyl or lower alkoxy group or halogen, or together with $R_3$ complete a fused benzene ring, $R_5$ is hydrogen, a lower alkyl group, phenyl or phenyl which is substituted by methyl and/or methoxy, $R_6$ is hydrogen, a lower alkyl or lower alkoxy group, halogen, a phenyl radical, an alkylsulfonyl or phenylsulfonyl radical, $R_7$ is hydrogen, a lower alkyl or lower alkoxy group or halogen, $R_8$ is a lower alkyl group, a hydroxyalkyl group containing at least 2 carbon atoms, the cyanoethyl group, phenyl or phenyl substituted by halogen, lower alkyl or lower alkoxy, or is a cycloalkyl radical or an aralkyl radical, $R_9$ is a lower alkyl group, a hydroxyalkyl group, an alkoxyalkyl group, an unsubstituted or substituted aralkyl group or a radical selected from the group consisting of $—CH_2CN$, $—CH_2CONH_2$ and $—CH_2—COOR$, in which R is $C_1$–$C_4$alkyl, and X is halogen, an alkylsulfonyl group or a phenylsulfonyl group which is unsubstituted or substituted by lower alkyl.

Further suitable cationic fluorescent whitening agents are distyrylbenzenes of formula

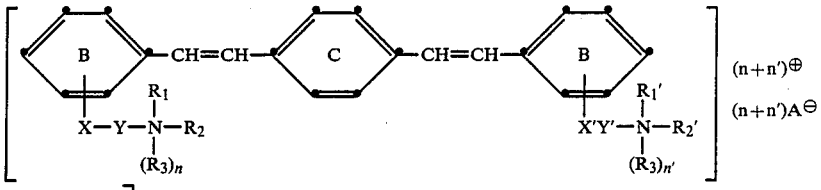

wherein

X and X′ are each independently of the other —COO— or —CON($R_4$)— in ortho-position, a direct bond, oxygen, sulfur, —O—$C_1$–$C_3$alkylene—CON($R_4$)—, —$SO_2$N($R_4$)—, —O—$C_1$–$C_3$alkylene—COO— or —OCO—, Y and Y′ are each independently of the other $C_1$–$C_{20}$alkylene, $R_1$ and $R_1'$ are each independently of the other unsubstituted or substituted $C_1$–$C_{18}$alkyl, $C_3$–$C_4$alkenyl, or together with $R_2$ or $R_2'$ are a heterocyclic ring, $R_2$ and $R_2'$ are each independently of the other unsubstituted or substituted $C_1$–$C_8$alkyl, $C_3$–$C_4$alkenyl, or together with $R_1$ or $R_1'$ are a heterocyclic ring or $R_1$ and $R_2$ or $R_1'$ and $R_2'$ together with $R_3$ are a pyridine or picoline ring, $R_3$ is hydrogen, unsubstituted or substituted $C_1$–$C_4$alkyl or $C_3$–$C_4$alkenyl, or together with $R_1$ and $R_2$ or $R_1'$ and $R_2'$ is a pyridine or picoline ring, $R_4$ is hydrogen or unsubstituted or substituted $C_1$–$C_6$alkyl, $A^{\ominus}$ is a colourless anion, and n and n′ are each independently of the other 0 or 1, and the benzene nuclei B and C may also carry non-chromophoric substituents.

Particularly useful fluorescent whitening agents are those of formula

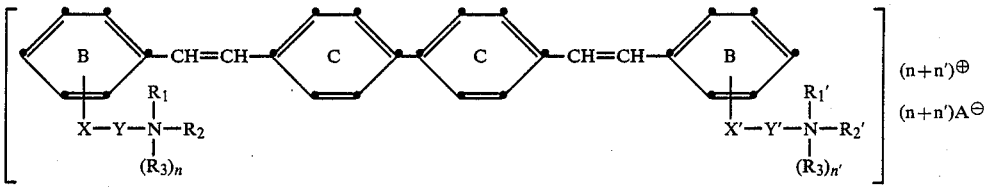

wherein

X and X′ are each independently of the other a direct bond, oxygen, sulfur, —O—$C_1$–$C_3$alkylene—CON($R_4$)—, —CON($R_4$)—, —O—$C_1$–$C_3$alkylene—COO—, —OCO— or —COO—, with the proviso that, if n+n′ is O, X and X′ may not be —CON($R_4$)— or —O—$C_1$–$C_3$alkylene—CON($R_4$)— and, if n+n′ is 2 and X and X′ are —CON($R_4$)— or —CO, $A^{\ominus}$ may not be the phosphite or phosphonate anion, Y and Y′ are each independently of the other $C_1$–$C_{20}$alkylene, $R_1$ and $R_1'$ are each indepdently of the other unsubsti tuted or substituted $C_1$–$C_8$alkyl or $C_3$–$C_4$alkenyl, or together with $R_2$ or $R_2'$ are a heterocyclic ring, $R_2$ and $R_2'$ are each independently of the other unsubs tituted or substituted $C_1$–$C_8$alkyl or $C_3$–$C_4$alkenyl, or together with $R_1$ or $R_1'$ are a heterocyclic ring, or $R_1$ and $R_2$ or $R_1'$ and $R_2'$ together with $R_3$ are a pyridine or picoline ring, $R_3$ is hydrogen, unsubstituted or substituted $C_1$–$C_4$alkyl or $C_3$–$C_4$alkenyl, or together with $R_1$ and $R_2$ or $R_1'$ and $R_2$ ∝ 0 is a pyridine or picoline ring, $R_4$ is hydrogen or unsubstituted or substituted $C_1$–$C_6$alkyl, $A^{\ominus}$ is a colourless anion, and n and n' are each independently of the other 0 or 1, and the benzene nuclei B and C may also carry non-chromophoric substituents.

The most fluorescent whitening agent of this class is that of formula

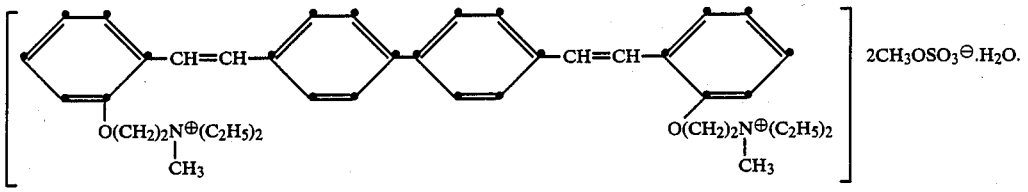

All these amphoteric and cationic fluorescent whitening agents are known (q.v. for example EP-A-0 059 684, DE-A-2 159 469, EP-A-0 019 078 and EP-A-0 019 702) and can be prepared by known methods.

The amphoteric and cationic fluorescent whitening agents eligible for use in the process of this invention are added to the aftertreatment liquor in total amounts of 0.1 to 3 g/l, preferably of 1 to 2 g/l.

Synthetic resins may also be added to the aftertreatment liquor. These are synthetic, non-crystalline resinous compounds that soften when heated, are capable of film formation, and are insoluble in water. They are usually macromolecules that are obtained by polymerisation or polycondensation and are e.g. phenol/formaldehyde resins, polyesters, polyamides, epoxy resins (condensates of epichlorohydrin and diphenylolpropane, crosslinked with e.g. urea/formaldehyde). In this connection, particularly interesting synthetic resins are etherified glycol resins.

The process if preferably carried out at room temperature, and the aftertreatment liquor can be applied by different methods, preferably by padding.

After the cellulose or cellulosic material printed with reactive dyes has been treated with the aftertreatment liquor, the material is dried, then heated to 100°–200° C. for 10 seconds to 10 minutes, and finished.

The aqueous liquor for carrying out the process also falls within the scope of the invention, said liquor comprising at least one cationic assistant and at least one amphoteric fluorescent whitening agent and/or at least one cationic fluorescent whitening agent and, as optional component, a synthetic resin.

Suitable cationic assistants, amphoteric and cationic fluorescent whitening agents and synthetic resins are those cited above.

The invention is illustrated by the following Examples.

EXAMPLE 1

After it has been washed off, cotton fabric printed in conventional manner with the reactive dye of formula

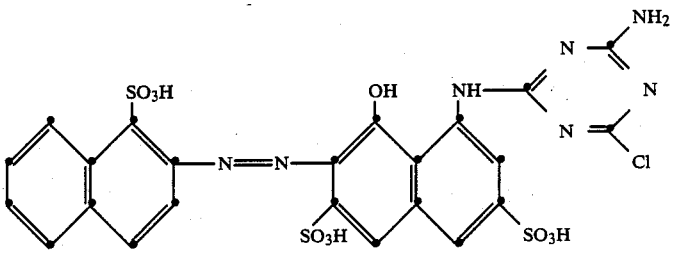

is impregnated at room temperature to a pick-up of 60% with an aqueous padding liquor containing:

40 g/l of the synthetic resin of formula

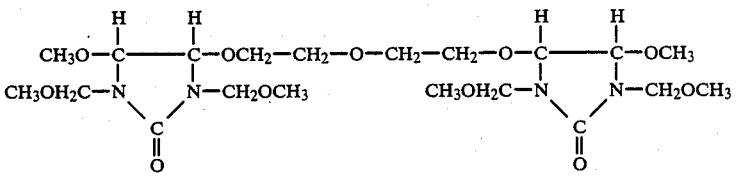

3.3 g/l of a condensate of ethylenediamine dihydrochloride, dicyandiamide and formaldehyde, 1.2 g/l of the amphoteric fluorescent whitening agent of formula

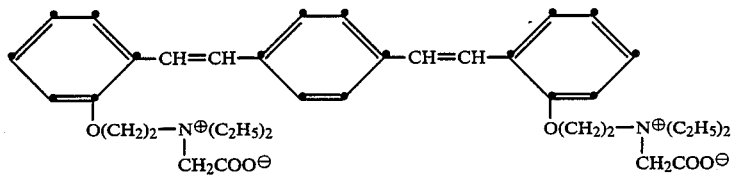

and 16 g/l of a compound of formula $MgCl_2.6H_2O$ as catalyst. The cotton fabric is then dried at 60° C. and treated with hot air of 150° C. for 5 minutes.

The finished cotton fabric so obtained is very washfast and has a good degree of whiteness.

Cotton fabric with a comparably good finish is obtained by using the same amount of a catalyst of formula $MgCl_2+AlCl_3$ or $MgCl_2.6H_2O+0.2-0.5$ g/l of $NaBF_4$ instead of the catalyst of formula $MgCl_2.6H_2O$ and otherwise carrying out the same procedure.

EXAMPLE 2

The procedure of Example 1 is repeated, using 1 g/l of the cationic fluorescent whitening agent of formula

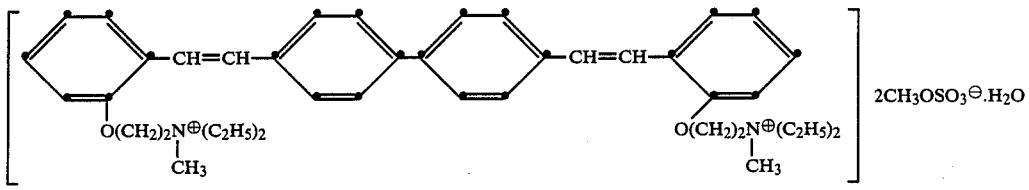

instead of the amphoteric fluorescent whitening agent. The finished cotton fabric is very washfast and has a good degree of whiteness.

What is claimed is:

1. A process for aftertreating cellulose or cellulosic materials printed with reactive dyes, which comprises using an aqueous aftertreatment liquor that contains at least one cationic assistant in an amount effective to improve wetfastness properties of the dyed material, and 0.1 to 3 g/l of at least one member selected from the group consisting of an amphoteric fluorescent whitening agent and a cationic fluorescent whitening agent.

2. An aqueous aftertreatment liquor for carrying out the process as claimed in claim 1, which liquor comprises at least one cationic assistant in an amount effective to improve wetfastness properties of the dyed material, and 0.1 to 3 g/l of at least one member selected from the group consisting of an amphoteric fluorescent whitening agent and a cationic fluorescent whitening agent, or which liquor comprises at least one cationic assistant in an amount effective to improve wetfastness properties of the dyed material, 0.1 to 3 g/l of at least one member selected from the group consisting of an amphoteric fluorescent whitening agent and a cationic fluorescent whitening agent, and a synthetic non-crystalline resinous compound that softens when heated, is capable of film formation and is insoluble in water.

3. A process according to claim 1, wherein the cationic assistant is an amine/formaldehyde condensate.

4. A process according to claim 1, wherein the cationic assistant is a condensate of ethylenediamine dihydrochloride, dicyandiamide and formaldehyde.

5. A process according to claim 1, wherein the cationic assistant is added to the aftertreatment liquor in an amount of 1 to 10 g/l.

6. A process according to claim 1, which comprises using an amphoteric fluorescent whitening agent of formula

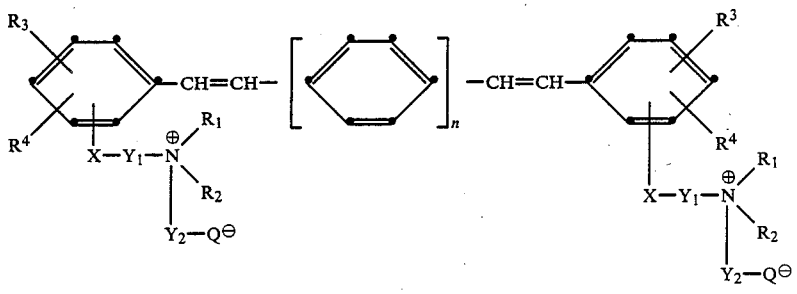

wherein

X is oxygen, sulfur, a direct bond, $—SO_2N(R_5)—$, $—CON(R_5)—$ or —COO—, $Y_1$ and $Y_2$ are each independently of the other $C_1$-$C_4$alkylene or hydroxypropylene, $R_1$ and $R_2$ are each independently of the other $C_1$-$C_4$alkyl or together with the N-atom are a pyrrolidine, piperidine, hexamethylenimine or morpholine ring, and $R_1$ together with $R_5$ are also a piperazine ring, $R_3$ and $R_4$ are hydrogen, $C_1$-$C_4$alkyl, chlorine, $C_1$-$C_4$alkoxy, $C_3$-$C_4$-alkenyl, or in ortho-position to each other $R_3$ and $R_4$ together are a trimethylene or tetramethylene group, $R_5$ is hydrogen, $C_1$-$C_4$alkyl, cyanoethyl, or together with $R_1$ is a piperazine ring, Q is —COO or $—SO_3$, and n is 1 or 2.

7. A process according to claim 6, which comprises using an amphoteric fluorescent whitening agent of formula
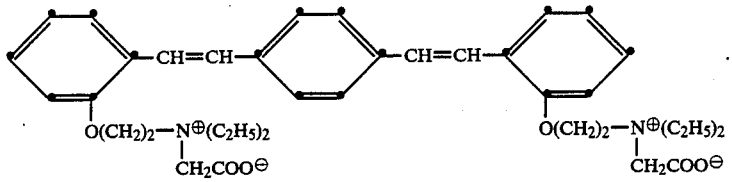
8. A process according to claim 1, wherein a synthetic resin is added to the aftertreatment bath.
9. A process according to claim 1 which is carried out at room temperature.
10. Material treated by the process as claimed in claim 1 or with the liquor as claimed in claim 2.
* * * * *